US007681814B2

(12) United States Patent
Krebs et al.

(10) Patent No.: US 7,681,814 B2
(45) Date of Patent: Mar. 23, 2010

(54) JET MILL WITH INTEGRATED DYNAMIC CLASSIFIER

(75) Inventors: Claus Krebs, Krefeld (DE); Carsten Rosenhahn, Krefeld (DE)

(73) Assignee: LANXESS Deutschland GmbH, Leverkusen (DE)

( * ) Notice: Subject to any disclaimer, the term of this patent is extended or adjusted under 35 U.S.C. 154(b) by 402 days.

(21) Appl. No.: 11/495,978

(22) Filed: Jul. 28, 2006

(65) Prior Publication Data

US 2007/0029416 A1 Feb. 8, 2007

(30) Foreign Application Priority Data

Aug. 2, 2005 (DE) ..... 10 2005 036 211

(51) Int. Cl.

| | |
|---|---|
| ***B02B 1/00*** | (2006.01) |
| ***B02B 5/02*** | (2006.01) |
| ***B02C 11/08*** | (2006.01) |
| ***B02C 21/00*** | (2006.01) |
| ***B07B 4/00*** | (2006.01) |
| ***B07B 7/00*** | (2006.01) |

(52) U.S. Cl. ..... 241/39; 241/40

(58) Field of Classification Search ..... 241/39, 241/40, 38

See application file for complete search history.

(56) References Cited

U.S. PATENT DOCUMENTS

| | | | | |
|---|---|---|---|---|
| 1,847,009 A | | 2/1932 | Kollbohm | |
| 2,032,827 A | | 3/1936 | Andrews | 83/46 |
| 2,237,091 A | | 4/1941 | Stephanoff | 83/46 |
| 3,348,779 A | * | 10/1967 | Andrews | 241/39 |
| 3,468,489 A | * | 9/1969 | Andrews | 241/39 |
| 3,688,991 A | * | 9/1972 | Andrews | 241/5 |
| 3,734,413 A | | 5/1973 | Kaiser | 241/39 |
| 4,198,004 A | * | 4/1980 | Albus et al. | 241/39 |
| 4,824,030 A | | 4/1989 | Kano et al. | 241/39 |
| 5,336,271 A | * | 8/1994 | Ishizaka et al. | 23/293 R |
| 5,421,524 A | * | 6/1995 | Haddow | 241/5 |
| 7,040,557 B2 | * | 5/2006 | Graham et al. | 241/1 |

FOREIGN PATENT DOCUMENTS

| | | |
|---|---|---|
| DE | 1159744 | 7/2006 |

* cited by examiner

*Primary Examiner*—Bena Miller
(74) *Attorney, Agent, or Firm*—Nicanor A. Kohncke

(57) ABSTRACT

The present invention relates to a jet mill for grinding and classifying material having an integrated dynamic classifier section connected to a conveying section to and from which a fine material and a material to be further ground are conveyed. The integrated dynamic classifier section of the present invention allows for the separation of a fine material from a material to be further ground. Furthermore, the present invention also includes a method of using such a jet mill having an integrated dynamic classifier section for grinding and classifying of material.

12 Claims, 5 Drawing Sheets

JET MILL WITH INTEGRATED DYNAMIC CLASSIFIER

This application claims the benefit of German Application No. DE102005036211.7 filed Aug. 2, 2005.

BACKGROUND OF THE INVENTION

1. Field of the Invention

The present invention relates to a jet mill in which a dynamic classifier is integrated, and to a method for using the same.

2. Brief Description of the Prior Art

Jet mills have long been known as well suited for the production of extremely finely ground products (fine material). For instance, as early as 1935, the U.S. Pat. No. 2,032,827 B1 describes the construction of a cylindrical jet mill.

Later, such mills were used as a basis for developing so-called injector jet mills, in which the material to be ground that is to be comminuted is accelerated in a guiding tube, the injector, by a high-speed stream of gas and is then comminuted on impact, either against a baffle plate, or by interparticle collision (U.S. Pat. No. 1,847,009 B1).

It is disadvantageous for such a mill that, on account of the poor classification within the mill chamber, small amounts of coarse grain get into the fine material. In products for the coatings industry, even minute amounts of coarse grain have adverse effects on the use of these materials. For the purposes of the application, "coarse grain" means particles which have a particle size d(97) of >5 μm. "Particle size d(97)" means the particle size in μm below which 97% of all measured particles are in the volume distribution. If d(97)>5 μm, the pigment is of micronized quality.

In patent application DE 1159744 A1, it is attempted to counteract this disadvantage by combining the grinding unit with a dynamic air classifier. The air classifying pre-classification has the effect that the air classifier is in a zone where there is little coarse material. However, it is problematical here that the air flow rates between the air classifier and the mill cannot be synchronized well. During operation with the usual volumetric flows of propelling gas and grinding gas, the radial flow velocities against the air classifier are too great, or in the case of an air classifier of a larger size, the grinding zone gets too close to the air classifier. The required product qualities therefore cannot be achieved with this technology.

U.S. Pat. No. 2,237,091 B1 describes a so-called oval tube jet mill, in which a different type of combination of jet mill with static classification is obtained by separating the classifying zone and the grinding chamber. In these mills described, a deflecting type of separation is used as the classifying effect. In the known prior art, a static classifier is not capable in principle of adequately separating coarse grain.

DE 3730597 A1 and DE 2092626 A1 describe the combination of a static spiral air classifier and an oval jet mill. However, spiral air classifiers show the disadvantages of static classification. The required product qualities likewise cannot be achieved with this technology.

In a so-called fluidized-bed counter jet mill, the aforementioned disadvantages are overcome by the classifying chamber and the grinding chamber being physically separated, and an externally driven dynamic classifier, for example in the form of a paddle air classifier, being used as the classifier (DE 2040519 A1). The required product qualities likewise cannot be achieved with this technology.

The object of the present invention was therefore to provide a jet mill which makes it possible to remove ground material (54) with a particle size d(97) of ≦5 μm, preferably ≦3 μm after grinding as fine material.

SUMMARY OF THE INVENTION

This object was achieved by a jet mill with at least one grinding zone (2), characterized in that, in the jet mill:

- at least one dynamic classifier (55) is integrated, comprising a classifying wheel (45) and a classifying zone (4) and including a separate conveying section (3) and a separate coarse-material return (6) into the grinding zone (2); and
- a product feed (1) and a fine-material outlet (5) are integrated;

the material to be ground (54) which is fed in at the product feed (1) and subsequently ground being classified by the dynamic classifier (55) and removed as fine material at the fine-material outlet (5).

Surprisingly, fine material with a particle size d(97) of <5 μm, preferably <3 μm (53), is produced by the jet mill according to the invention.

DETAILED DESCRIPTION OF THE INVENTION

The classifying wheel (45) is preferably externally driven, for example by a classifying-wheel drive motor (46).

Ground material (54) which is rejected from the classifying zone (4) as excessively coarse material preferably passes via the outlet opening of the coarse-material return (48) into the coarse-material return (6).

Conveying sections (3) or coarse-material returns (6) are preferably arranged between one or more grinding zones (2) and one or more classifying zones (4). In the case of a single grinding zone (2) and a single classifying zone (4), a jet mill with an oval form is thereby created. In the case of a number of grinding zones (2) and classifying zones (4), forms with three or more corners may be produced.

The relative sizes of the grinding zone (2) or grinding zones (2) and the classifying zone (4) or classifying zones (4) are preferably independent of one another.

The conveying section (3) or conveying sections (3) preferably includes or include one or more flow diverters (41). A flow diverter (41) is intended to prevent the ground material (54) from impinging directly on the classifying wheel (45).

A flow diverter (41) has an angle of 2 to 25°, preferably of 9 to 11°.

The dynamic classifier (55) preferably has a classifying wheel (45) with lamellae (49).

The lamellae (49) are preferably straight, angled and/or curved.

The product feed (1) is preferably accomplished by an injector (11), which uses compressed gases such as air, nitrogen, steam, carbon dioxide, inert gas, hydrogen, oxygen or mixtures thereof. With the aid of the injector propelling nozzle (12) and the injector conveying tube (15), the material to be ground (54) is preferably fed into the grinding zone (2).

The outer walling (44) of the dynamic classifier (55) is preferably flushed by compressed gases such as air, nitrogen, steam, carbon dioxide, inert gas, hydrogen, oxygen or mixtures thereof.

The flushing may take place for example by means of a ring of blades, nozzles or a sintered metal plate or a combination of these. The supplying of the compressed gas may take place for example through the secondary air inlet (42). The secondary air inlet (42) encourages disagglomeration and the delivery of fine material is improved as a result. A secondary air distributor (43) allows secondary air preferably to be introduced through the secondary air inlet openings (47) into the classifying zone (4).

The jet mill may preferably have classifying-wheel gap flushing (52), in order to prevent coarse material from getting past the dynamic classifier (55) into the fine material (53).

The invention also comprises a method for grinding material to be ground (54) with the jet mill described above, characterized in that material to be ground (54) is fed to the jet mill at the product feed (1) and is removed as fine material (53) at the fine-material outlet (5).

The material to be ground (54) is preferably fed to the dynamic classifier (55) at the product feed (1) in a pre-accelerated manner.

The device is explained in more detail below on the basis of drawings representing a number of embodiments. Further features that are essential for the invention and advantages of the invention are disclosed by the drawings and the description.

In the drawings:

FIG. 1 shows a sectional drawing of the jet mill from the front;

FIG. 2 shows a sectional drawing of the jet mill from the side.

Technical Description of the Jet Mill

The jet mill substantially comprises an oval-shaped tube comprising a conveying section (3) and a coarse-material return (6). The grinding zone (2) and the classifying zone (4) are spatially separate.

The material to be ground (54) is conveyed pneumatically into the grinding zone (2) via a product feed (1) with the aid of an injector (11), preferably via an injector propelling nozzle (12). Alternatively, pneumatic pressure conveyance may be used. It is also conceivable to use pressure locks to introduce the material into the unit.

The material to be ground (54) enters the grinding zone (2) and is accelerated by the compressed gas which is expanding, preferably at the speed of sound, from the grinding nozzles (21). The combination takes place by interparticle impact. The grinding nozzles (21) are preferably tangentially adjusted.

Over the conveying section (3), the ground material (54) that is produced by the grinding zone (2) is fed to the dynamic classifier (55), preferably in a pre-accelerated manner, which can be further assisted by acceleration before the inlet into the classifying zone (4). In addition, the flow diverter (41) prevents the flow of ground material (54) impinging directly on the classifying wheel (45). In addition, air fed in via the walling (44) prevents re-agglomeration of the ground material (54).

At the centre of the classifying zone (4), the classifying wheel (45) is installed. Adequately fine ground material (54) is discharged with the compressed gas, sucked through the classifying wheel (45), as fine material (53). Excessively coarse ground material (54) is rejected by the classifying wheel (45). The lamellae (49) of the classifying wheel (45) may be straight, angled and/or curved.

The jet mill may preferably have a classifying-wheel gap flushing (52), in order to prevent coarse material from getting past the dynamic classifier (55) into the fine material (53).

After the fine-material outlet (5), the fine material (53) is separated from the compressed gas in a downstream separator, such as for example a cyclone or a filter. The jet mill may be operated by a blower, both with negative pressure and with positive pressure.

Coarse fractions of the ground material (54) that are rejected by the classifying wheel (45) are returned to the grinding zone (2) from the classifying zone (4) via the coarse-material return (6), through the outlet opening for coarse-material return.

The subject matter of the present invention is provided not only by the subject matter of the individual patent claims but also by the combination of the individual patent claims with one another. The same applies to all the parameters disclosed in the description and any desired combinations thereof.

The invention is explained in more detail on the basis of the following examples, without thereby intending to restrict the invention.

LEGEND FOR DRAWING

Figure 1:
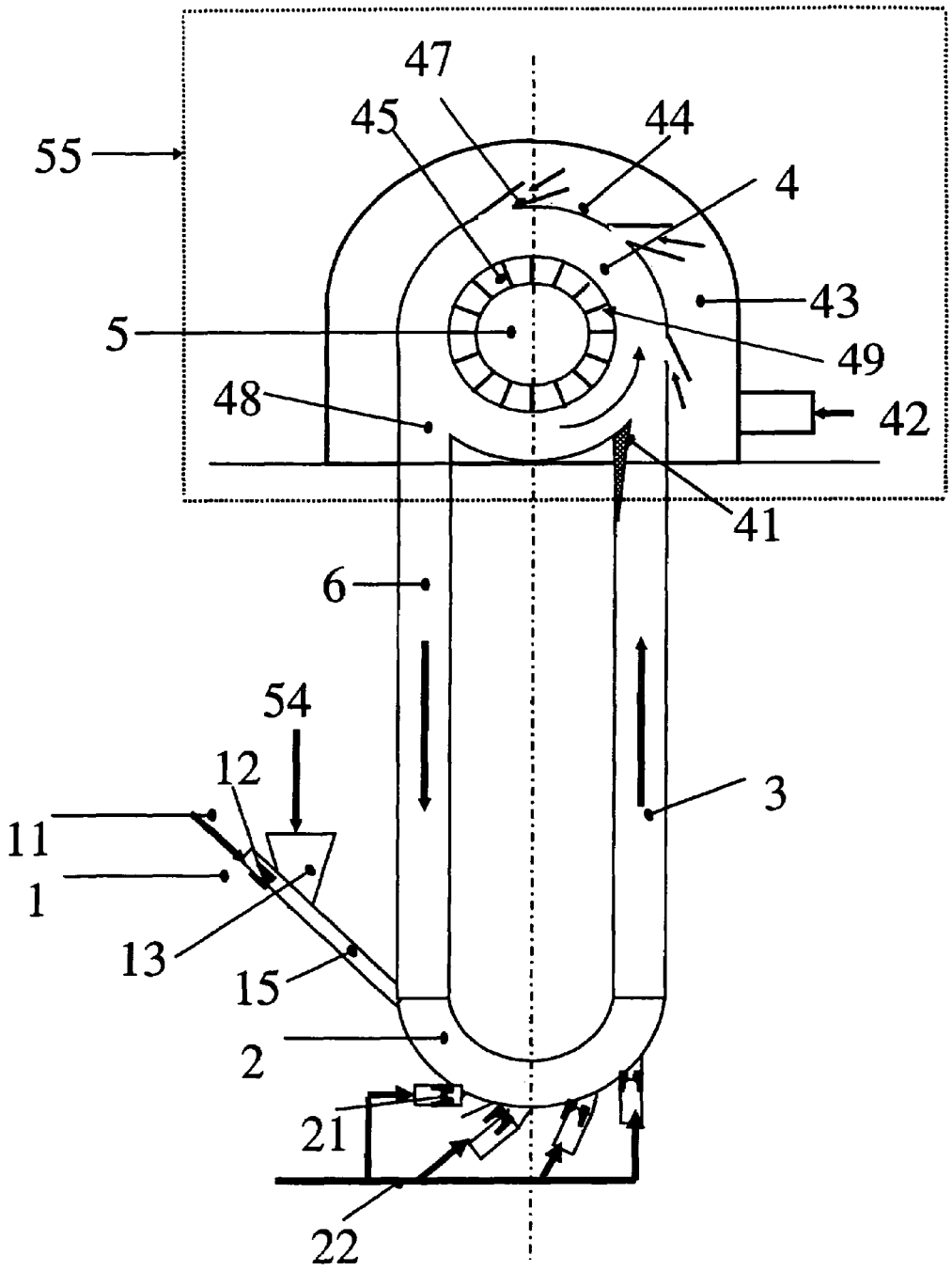
FIG. 1 schematically illustrates a frontal sectional drawing of the jet mill.
Figure 2:
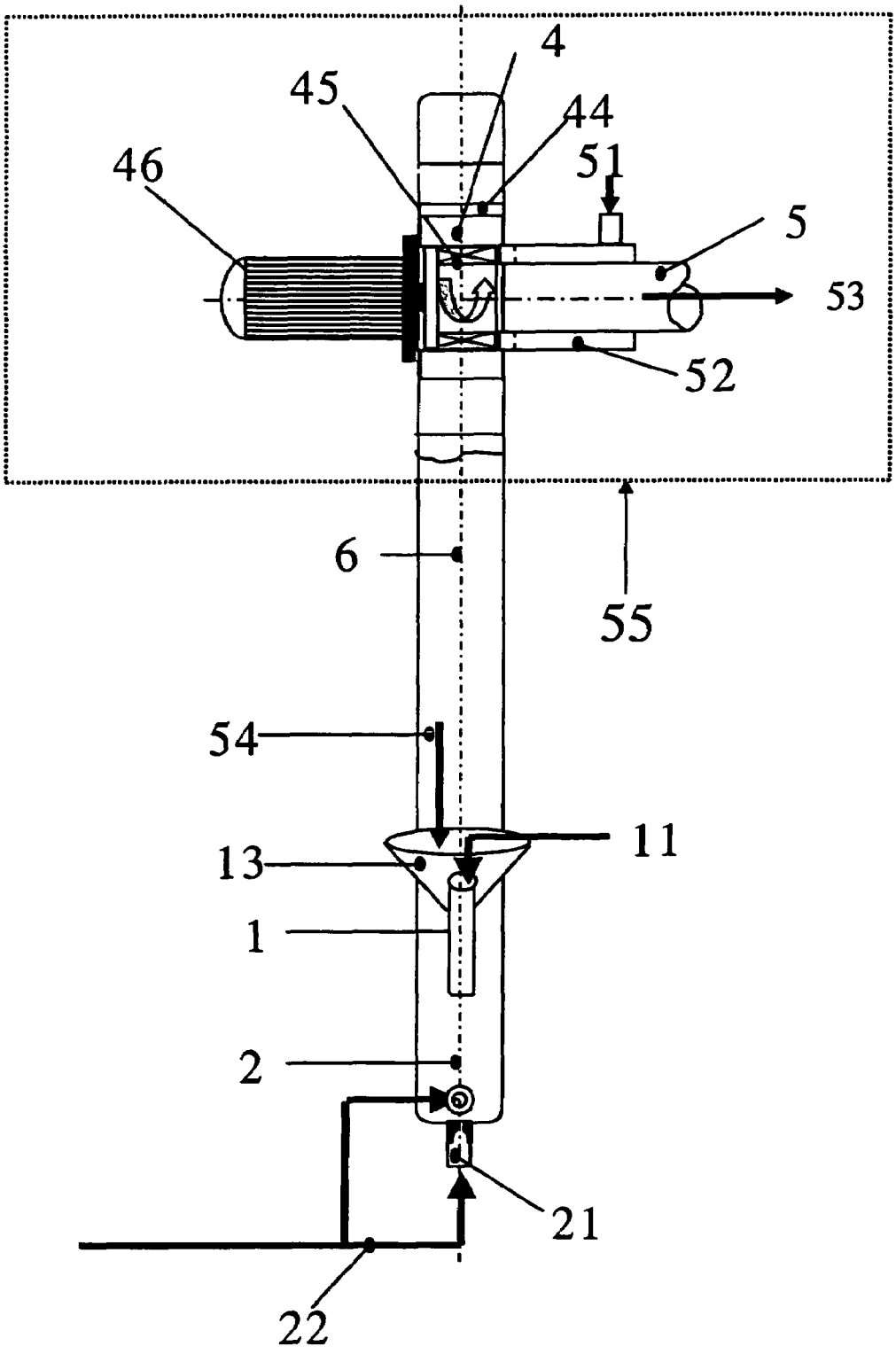
FIG. 2 schematically illustrates a sectional drawing of the jet mill viewed from the side.

1. Product feed
2. Grinding zone
3. Conveying section
4. Classifying zone
5. Fine-material outlet
6. Coarse-material return
11. Injector
12. Injector propelling nozzle
13. Injector funnel
15. Injector conveying tube
21. Grinding nozzle
22. Compressed-gas distributor
41. Flow diverter
42. Secondary air inlet
43. Secondary air distributor
44. Walling
45. Classifying wheel
46. Classifying-wheel drive motor
47. Secondary air inlet opening
48. Outlet opening for coarse-material return
49. Lamellae
51. Inlet for classifying wheel flushing gas
52. Classifying wheel gap flushing

53. Fine material

54. Material to be ground/ground material

55. Dynamic classifier

EXAMPLES

Technical Data of the Test Machine Used in the Present Case

| | |
|---|---|
| compressed gas | air (4 bar) |
| number of grinding nozzles (21) | four |
| radius of curvature of the grinding zone (2) | 0.145 m |
| length of the conveying section (3) | 1 m |
| form of the inlet into the classifying zone (4) | 50*100 mm rectangular |
| diameter of classifying zone (4) | 300 mm |
| diameter of classifying wheel (45) | 0.2 m |
| height of classifying wheel (45) | 0.1 m |

Description of the Measuring Methods Used:

Particle Size Distribution

The particle size distribution was determined by laser diffraction ("Mastersizer-S" device from the Malvern Instruments company) in an aqueous solution with 0.1% sodium phosphate as a dispersing aid after ultrasonic dispersion at 200 W for two minutes.

The quality of material ground by steam jet can be described by the particle size distribution. According to experience, micronized quality is achieved when the particle size distribution measured with a Mastersizer has no particles that are greater than 5 μm. Owing to the system used, laser diffraction measuring devices have great difficulties in exactly reproducing the margins of the particle size distribution. According to experience, the characteristic value "d(97)" of a particle size distribution is a faithful measured variable for the quality of the grinding fineness of pigments.

The particle size distribution is represented in FIGS. 3 to 7. This produces two lines.

——identifies the volume distribution of the individual particle sizes. The x axis shows the particle diameter in μm. The $Y_1$ axis indicates the proportion of the particles in percent by volume.

- - - -identifies the integration of the line ——. The x axis indicates the particle diameter in μm. The $Y_2$ axis indicates the proportion of the particles in percent by volume.

Figure 3:
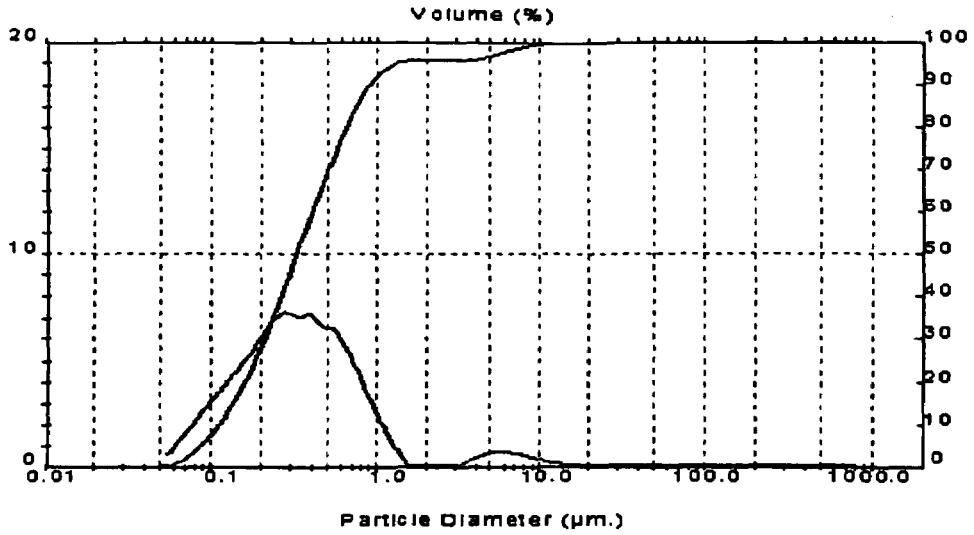
FIG. 3 schematically graphs iron oxide red pigment, not micronized quality wherein d(97)=6 μm.

FIG. 3 shows iron oxide red pigment, not micronized quality; d(97)=6 μm.

Figure 4:
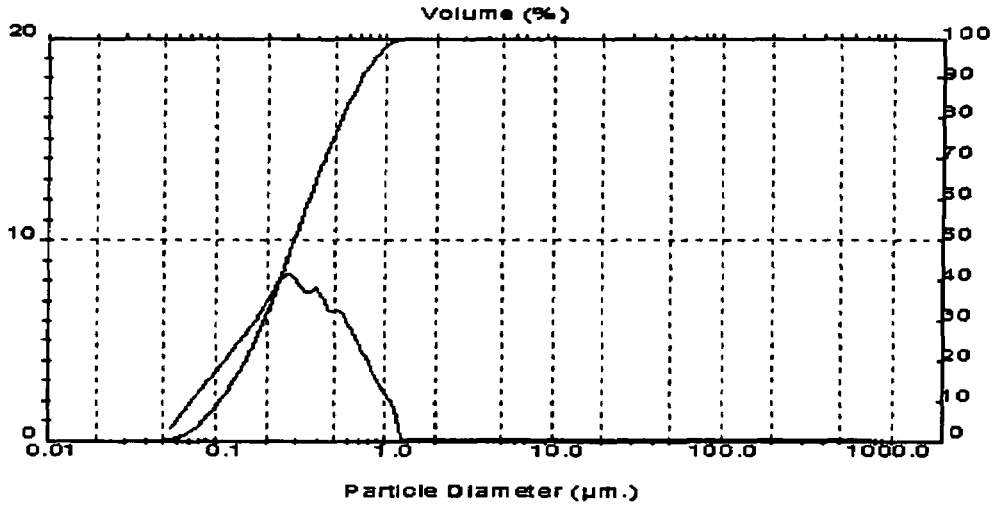
FIG. 4 schematically graphs iron oxide red pigment, micronized quality wherein d(97)=1.2 μm.

FIG. 4 shows iron oxide red pigment, micronized quality; d(97)=1.2 μm.

Example 1

As material to be ground (54), material that is difficult to grind was prepared in accordance with DE 4003255 A1 of Example 2, but was not ground, as required in the example of the patent, but used as follows in its unground form. The material concerned is a manganese ferrite, a black powder which, as a ground material, is used inter alia as a colouring pigment in applications for coatings.

Description of the Grinding Parameters:

| | |
|---|---|
| initial grinding nozzle pressure | 4 bar |
| injector air rate | 54 $m^3/h$ |
| grinding air rate | 250 $m^3/h$ |
| classifying wheel speed | 5500 rpm |
| secondary air rate | 150 $m^3/h$ |
| solids throughput | 40 kg/h |
| gap flushing air | 120 $m^3/h$ |
| operating temperature | room temperature |

The particle size distribution was determined on the finished ground material to see whether the required grinding fineness could be achieved.

Figure 5:
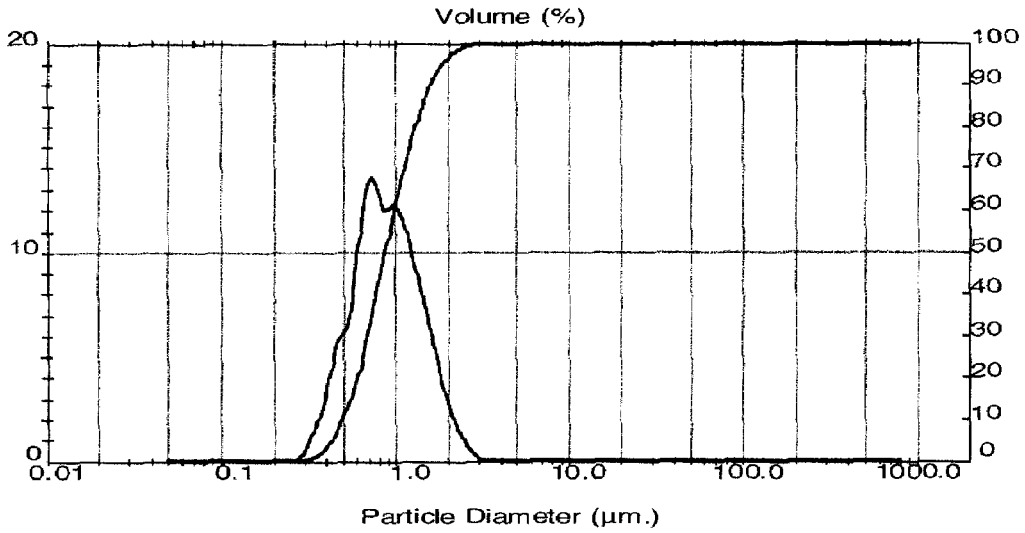
FIG. 5 schematically graphs a particle size distribution devoid of any coarse grain having a particle size greater than 3 μm in the fine material, wherein the d(97) characteristic value is 2.1 μm.

FIG. 5: The particle size distribution shows that there is no longer any coarse grain with a particle size greater than 3 μm in the fine material. Such grinding allowed micronized quality to be achieved. The d(97) characteristic value is 2.1 μm.

Example 2

The material to be ground (54) was prepared in accordance with DE 4003255 A1, but was not ground, as required in the example of the patent, but used in its unground form.

Description of the Grinding Parameters:

| | |
|---|---|
| initial grinding nozzle pressure | 4 bar |
| injector air rate | 55 $m^3/h$ |
| grinding air rate | 250 $m^3/h$ |
| classifying wheel speed | 5500 rpm |
| secondary air rate | 150 $m^3/h$ |
| solids throughput | 40 kg/h |
| gap flushing air | 120 $m^3/h$ |
| operating temperature | room temperature |

The particle size distribution was determined on the finished ground material to see whether the required grinding fineness could be achieved.

Figure 6:
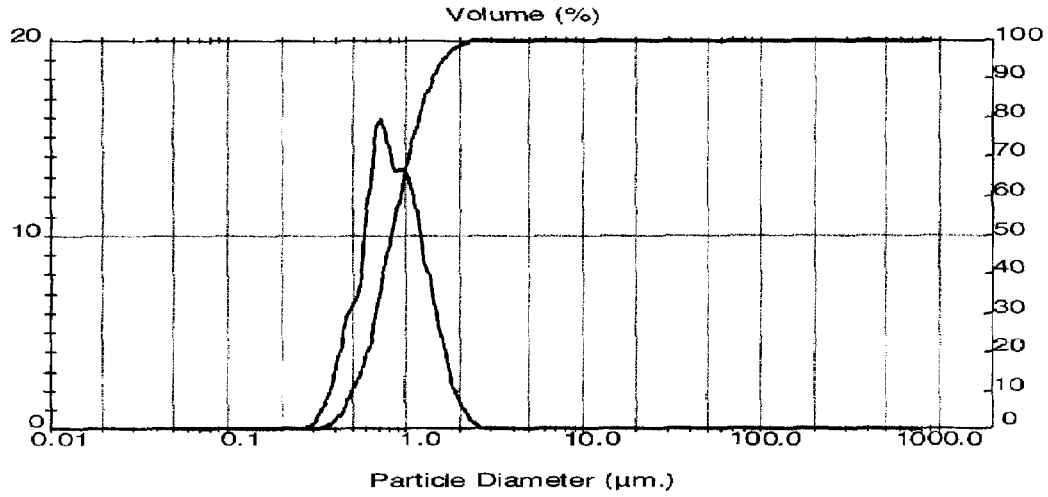
FIG. 6 schematically graphs a particle size distribution devoid of any coarse grain having a particle size greater than 3 μm in the fine material, wherein the d(97) characteristic value is 1.9 μm.

FIG. 6: The particle size distribution shows that there is no longer any coarse grain with a particle size greater than 3 μm in the fine material. Such grinding allowed micronized quality to be achieved. The d(97) characteristic value is 1.9 μm.

Comparative Example 3

The material to be ground (54) was prepared in accordance with DE 4003255 A1, but was not ground, as required in the example of the patent, but used in its unground form.

The grinding was carried out in a spiral jet mill according to the prior art (manufacturer Alpine, diameter 900 mm). Steam was used as the compressed gas.

A particle size distribution was determined on the finished ground material to see whether the required grinding fineness could be achieved.

Figure 7:
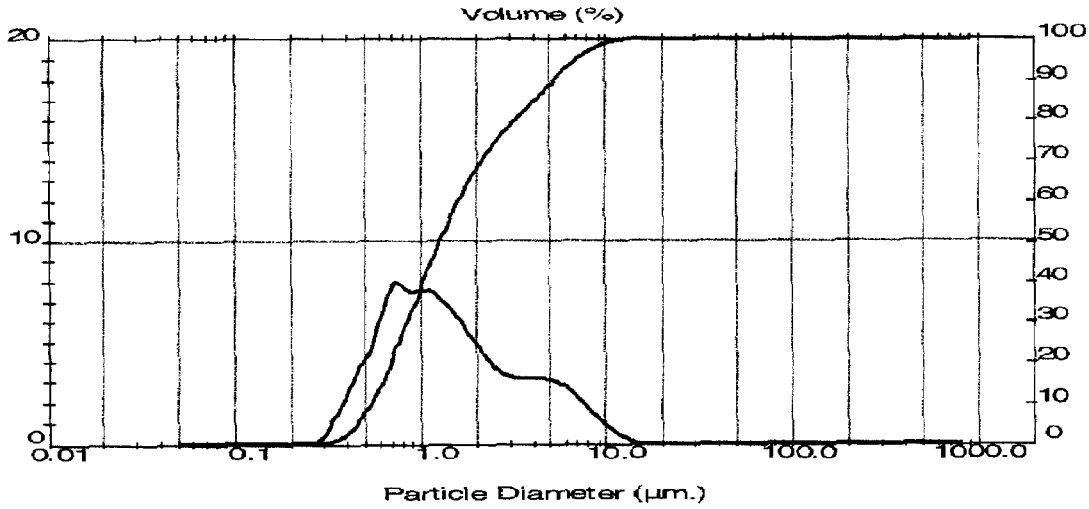
FIG. 7 schematically graphs a particle size distribution devoid of any coarse grain having a particle size greater than 3 μm in the fine material, wherein the d(97) characteristic value is 8.8 μm.

FIG. 7: The particle size distribution shows that there is coarse grain with a particle size greater than 3 μm in the fine material. Such grinding did not allow micronized quality to be achieved. The d(97) characteristic value is 8.8 μm.

The present invention has been described with reference to specific details and examples of particular embodiments thereof. It is not intended that such details and examples be regarded as limitations upon the scope of the invention except insofar as and to the extent that they are included in the accompanying claims.

What is claimed is:

1. A jet mill apparatus for producing, from a coarse material, a fine material and a material to be further ground, comprising:

a) a product feed (1) for introducing the coarse material into the jet mill apparatus;

b) a grinding zone (2) connected to the product feed (1);

c) a means for grinding positioned within the grinding zone (2), whereby the coarse material is formed into the fine material and the material to be further ground;

d) a conveying section (3) connected to the grinding zone (2) for conveying the fine material and the material to be further ground away from the grinding zone (2);

e) an integrated dynamic classifier section (55) connected to the conveying section (3) to which the fine material and the material to be further ground are conveyed, said integrated dynamic classifier section (55) further comprising:

e1) a classifying zone (4) being connected to the conveying section (3), e2) a classifying wheel (45) being mounted rotatably within the classifying zone (4) and being generally cylindrical and having both an interior surface and an exterior surface, wherein the circumference of the interior surface defines a hallow interior region and further wherein said interior surface and said exterior surface are penetrable by the fine material, but not penetrable by the material to be further ground, and e3) a classifying-wheel drive motor attached to the classifying wheel (45) for driving the rotation of the classifying wheel (45), wherein the fine material and the material to be further ground enter the classifying zone (4) from the conveying section (3) and where the fine material travels into the interior region of said classifying wheel (45);

f) a fine-material outlet (5) connected adjacent to the hallow interior region of the classifying wheel (45) through which the fine material is removed from the jet mill apparatus; and g) a coarse-material return (6) connected to the classifying zone (4) for circulating the material to be further ground back to the grinding zone (2).

2. The apparatus according to claim 1, wherein the conveying section (3) and the coarse-material return (6) are interposed between the grinding zone (2) and the classifying zone (4).

3. The apparatus according to claim 1, wherein the conveying section (3) includes a flow diverter (41) attached thereto for diverting the flow of the fine material and the material to be further ground from immediately contacting the classifying wheel (45) upon the entry of the fine material and the material to be further ground into the classifying zone (4).

4. The apparatus according to claim 3, wherein the flow diverter (41) has an angle of from 2 to 25 degrees.

5. The apparatus according to claim 3, wherein the flow diverter (41) has an angle of from 9 to 11 degrees.

6. The apparatus according to claim 1, wherein the classifying wheel (45) comprises lamellae (49).

7. The apparatus according to claim 6, wherein the lamellae (49) are straight, angled and/or curved.

8. The apparatus according to claim 1, wherein the product feed (1) further comprises an injector (11), which uses a compressed gas for introducing the coarse material into the jet mill apparatus.

9. The apparatus according to claim 8, wherein the gas is selected from the group consisting of: air, nitrogen, steam, carbon dioxide, inert gas, hydrogen, oxygen and mixtures thereof.

10. The apparatus according to claim 1, wherein the integrated dynamic classifier section (55) further comprises:

e4) a secondary gas distributor section (43) partially enclosing the classifying zone (4), e5) a secondary gas inlet (42) connected to the secondary gas distributor section (43), e6) a means for introducing a secondary gas into the secondary gas distributor section (43) via the secondary gas inlet (42), e7) an outer walling section (44) positioned between the secondary gas distributor section (43) and the classifying zone (4), and e8) a secondary gas inlet opening (47) through which the secondary gas can pass from the secondary gas distributor section (43) into the classifying zone (4).

11. The apparatus according to claim 10, wherein the secondary gas is selected from the group consisting of: air, nitrogen, steam, carbon dioxide, inert gas, hydrogen, oxygen, and mixtures thereof.

12. The apparatus according to claim 1, wherein the integrated dynamic classifier section (55) further comprises:

e4) a gap region between the classifying wheel (45) and the fine-material outlet (5);

e5) a gap-flushing section (52) mounted to the fine-material outlet (5) adjacent to the gap region, e6) a gap-flushing gas inlet (51) connected to the gap-flushing section (52) through which a gas may be introduced into the gap region, and e7) a means for introducing a gas into the gap-flushing section (52) via the gap-flushing gas inlet (51).

* * * * *